US011946252B2

(12) United States Patent
Shiao et al.

(10) Patent No.: US 11,946,252 B2
(45) Date of Patent: Apr. 2, 2024

(54) LOW PENETRATION POINT ASPHALT REINFORCED GLASS MAT AND ARTICLES INCLUDING THE SAME

(71) Applicant: BMIC LLC, Dallas, TX (US)

(72) Inventors: Ming-Liang Shiao, Basking Ridge, NJ (US); Jim Svec, Kearny, NJ (US); Brian Lee, Linden, NJ (US)

(73) Assignee: BMIC LLC, Dallas, TX (US)

( * ) Notice: Subject to any disclaimer, the term of this patent is extended or adjusted under 35 U.S.C. 154(b) by 178 days.

(21) Appl. No.: 17/512,400

(22) Filed: Oct. 27, 2021

(65) Prior Publication Data

US 2022/0127851 A1 Apr. 28, 2022

Related U.S. Application Data

(60) Provisional application No. 63/106,109, filed on Oct. 27, 2020.

(51) Int. Cl.

| | |
|---|---|
| ***E04D 1/20*** | (2006.01) |
| ***D06N 3/00*** | (2006.01) |
| ***D06N 5/00*** | (2006.01) |

(52) U.S. Cl.

CPC ..... *E04D 1/20* (2013.01); *D06N 3/0022* (2013.01); *D06N 3/0063* (2013.01); *D06N 3/0088* (2013.01); *D06N 5/003* (2013.01); *D06N 2201/082* (2013.01); *D06N 2203/08* (2013.01); *D06N 2209/103* (2013.01); *D06N 2211/06* (2013.01)

(58) Field of Classification Search

CPC ..... E04D 1/20; D06N 3/0022; D06N 3/0063; D06N 3/0088; D06N 5/003; D06N 2201/082; D06N 2203/08; D06N 2209/103; D06N 2211/06

See application file for complete search history.

(56) References Cited

U.S. PATENT DOCUMENTS

| | | | | |
|---|---|---|---|---|
| 3,332,830 | A * | 7/1967 | Tomlinson | D21J 1/00 428/190 |
| 5,744,229 | A | 4/1998 | Gleason et al. | |
| 5,932,665 | A | 8/1999 | Deporter et al. | |
| 6,114,464 | A | 9/2000 | Reck et al. | |
| 6,136,916 | A | 10/2000 | Arkens et al. | |
| 6,299,936 | B1 | 10/2001 | Reck et al. | |

(Continued)

FOREIGN PATENT DOCUMENTS

| | | | |
|---|---|---|---|
| EP | 1655400 | A1 | 5/2006 |

*Primary Examiner* — Nathan L Van Sell

(74) *Attorney, Agent, or Firm* — GREENBERG TRAURIG, LLP

(57) ABSTRACT

Some embodiments of the present disclosure relate to an roofing shingle comprising a low penetration point asphalt reinforced glass mat. In some embodiments, the reinforced glass mat comprises a glass mat and a reinforcement material. In some embodiments, the glass mat comprises a web of glass fibers. In some embodiments, the reinforcement material is embedded into the web of glass fibers of the glass mat. In some embodiments, the reinforced glass mat comprises a sufficient amount of the reinforcement material, so as to result in a nail shank shear resistance of 13 lbs to 17 lbs, according to ASTM 1761 at 140° F. Methods of making the roofing shingle and methods of forming a roofing shingle from the roofing shingle are also disclosed herein.

14 Claims, 3 Drawing Sheets

(56) References Cited

U.S. PATENT DOCUMENTS

| | | | | |
|---|---|---|---|---|
| 6,348,530 | B1 | 2/2002 | Reck et al. | |
| 6,737,369 | B2 | 5/2004 | Peng et al. | |
| 10,982,446 | B2 | 4/2021 | Swayne et al. | |
| 2005/0204675 | A1* | 9/2005 | Snyder | B32B 11/04 52/553 |
| 2005/0208861 | A1 | 9/2005 | Dwiggins et al. | |
| 2005/0222305 | A1* | 10/2005 | Trommelen | C08L 95/00 524/59 |
| 2008/0014813 | A1 | 1/2008 | Xing et al. | |
| 2008/0134612 | A1* | 6/2008 | Koschitzky | E04D 1/26 52/553 |
| 2010/0098912 | A1* | 4/2010 | Snyder | E04D 1/26 428/143 |
| 2011/0139366 | A1 | 6/2011 | Belt et al. | |
| 2016/0362339 | A1* | 12/2016 | Franzen | C04B 26/006 |

* cited by examiner

LOW PENETRATION POINT ASPHALT REINFORCED GLASS MAT AND ARTICLES INCLUDING THE SAME

CROSS-REFERENCE TO RELATED APPLICATIONS

This application claims the benefit of U.S. Provisional Application No. 63/106,109, entitled "LOW PENETRATION POINT ASPHALT REINFORCED GLASS MAT AND ARTICLES INCLUDING THE SAME," filed on Oct. 27, 2020, the entirety of which is hereby incorporated by reference.

FIELD

The present disclosure relates to a reinforced glass mat with enhanced nail shank shear resistance. In some embodiments, the reinforced glass mat may be included in an article, such as but not limited to, a roofing shingle.

BACKGROUND

One potential risk for nailing articles that include a glass mat, such as, but not limited to, roofing shingles, is the potential fabric tearing by nail shanks (e.g., by heavy foot traffic in a steep slope, especially during a very hot day). Improvements to the resistance to damages induced by fasteners such as nails are therefore highly desirable and necessary.

SUMMARY

In some embodiments, a roofing shingle includes a reinforced glass mat. In some embodiments, the reinforced glass mat includes a glass mat including a web of glass fibers. In some embodiments, the reinforced glass mat includes a first asphalt coating on at least a portion of the glass mat. In some embodiments, the first asphalt coating is at least partially embedded into the web of glass fibers. In some embodiments, the first asphalt coating includes low penetration point asphalt. In some embodiments, low penetration point asphalt is asphalt that has a penetration point ranging from 0 mm to 10 mm according to ASTM D-5 at 77° F. In some embodiments, a second asphalt coating surrounds the first asphalt coating. In some embodiments, the second asphalt coating is different from the first asphalt coating. In some embodiments, the reinforced glass mat includes the first asphalt coating in a sufficient amount so as to result in the reinforced glass mat having a nail shank shear resistance of 13 lbs to 17 lbs according to ASTM 1761 at 140° F.

In some embodiments, the first asphalt coating is an oxidized asphalt coating includes at least one filler. In some embodiments, the at least one filler is present in an amount of 1 wt % to 70 wt % based on a total weight of the oxidized asphalt coating. In some embodiments, the at least one filler is limestone powder, calcium carbonate powder, sand, granules, fly ash, fiberglass particles, stone dust, impurities, or any combination thereof.

In some embodiments, the sufficient amount of the first asphalt coating in the roofing shingle ranges from 5 wt % to 40 wt % based on a total weight of the roofing shingle.

In some embodiments, the second asphalt coating is an oxidized asphalt coating, a polymer modified asphalt coating, or any combination thereof. In some embodiments, the second asphalt coating includes at least one filler. In some embodiments, the second asphalt coating does not include at least one filler. In some embodiments, the penetration point of the second asphalt coating is different from the penetration point of the first asphalt coating.

In some embodiments, the penetration point of the second asphalt coating ranges from 15 mm to 45 mm according to ASTM D-5 at 77° F.

In some embodiments, the roofing shingle a plurality of granules. In some embodiments, the plurality of granules is embedded in the first asphalt coating, embedded in the second asphalt coating, or any combination thereof.

In some embodiments, the roofing shingle includes a headlap portion. In some embodiments, the first asphalt coating or the second asphalt coating is not present on the headlap portion.

In some embodiments, the second asphalt coating is present on the headlap portion.

In some embodiments, an entirety of the roofing shingle has a uniform thickness.

In some embodiments, the roofing shingle includes a nail zone, and wherein the asphalt coating or first asphalt coating is present in the nail zone.

In some embodiments, the first asphalt coating or the second asphalt coating is present in at least one portion of the roofing shingle other than the nail zone.

In some embodiments, a method includes obtaining a glass mat. In some embodiments, the glass mat comprises a web of glass fibers. In some embodiments, the method includes embedding, at least partially, an asphalt coating into the web of glass fibers, so as to form a reinforced glass mat. In some embodiments, the asphalt coating includes low penetration point asphalt. In some embodiments, low penetration point asphalt is asphalt that has a penetration point ranging from 0 mm to 10 mm according to ASTM D-5 at 77° F. In some embodiments, the embedding at least partially embeds the asphalt coating into the web of glass fibers in a sufficient amount so as to result in a reinforced glass mat having a nail shank shear resistance of 13 lbs to 17 lbs, according to ASTM 1761 at 140° F.

In some embodiments, the embedding is performed using a slot die, and the method comprises scraping excess asphalt coating from the reinforced glass mat, so as to form an roofing shingle having a uniform thickness.

In some embodiments, the asphalt coating is a first asphalt coating and wherein the method comprises applying a second additional asphalt coating to the reinforced glass mat via roll coating.

Some embodiments of the present disclosure relate to an article. In some embodiments, the article includes a reinforced glass mat. In some embodiments, the reinforced glass mat includes a glass mat that includes a web of glass fibers. In some embodiments, a first asphalt coating is on at least a portion of the glass mat. In some embodiments, the first asphalt coating is embedded into the web of glass fibers. In some embodiments, the first asphalt coating includes "low penetration point asphalt," where low penetration point asphalt is asphalt having a penetration point ranging from 0 mm to 10 mm according to ASTM D-5 at 77° F. In some embodiments, a second asphalt coating surrounds the first asphalt coating. In some embodiments, the second asphalt coating is different from the first asphalt coating. In some embodiments, the article may include the first asphalt coating in a sufficient amount so as to result in the article having a nail shank shear resistance of 13 lbs to 17 lbs, according to ASTM 1761 at 140° F.

In some embodiments, the penetration point of the second asphalt coating ranges from 15 mm to 45 mm according to ASTM D-5 at 77° F.

Some embodiments of the present disclosure relate to a method of manufacturing the article. In some embodiments, the method includes obtaining a glass mat, where the glass mat includes a web of glass fibers. In some embodiments, the asphalt coating is embedded into the web of glass fibers, so as to form a reinforced glass mat.

BRIEF DESCRIPTION OF THE DRAWINGS

Reference is made to the drawings that form a part of this disclosure, and which illustrate embodiments in which the systems and methods described herein can be practiced.

DETAILED DESCRIPTION

Figure 1:
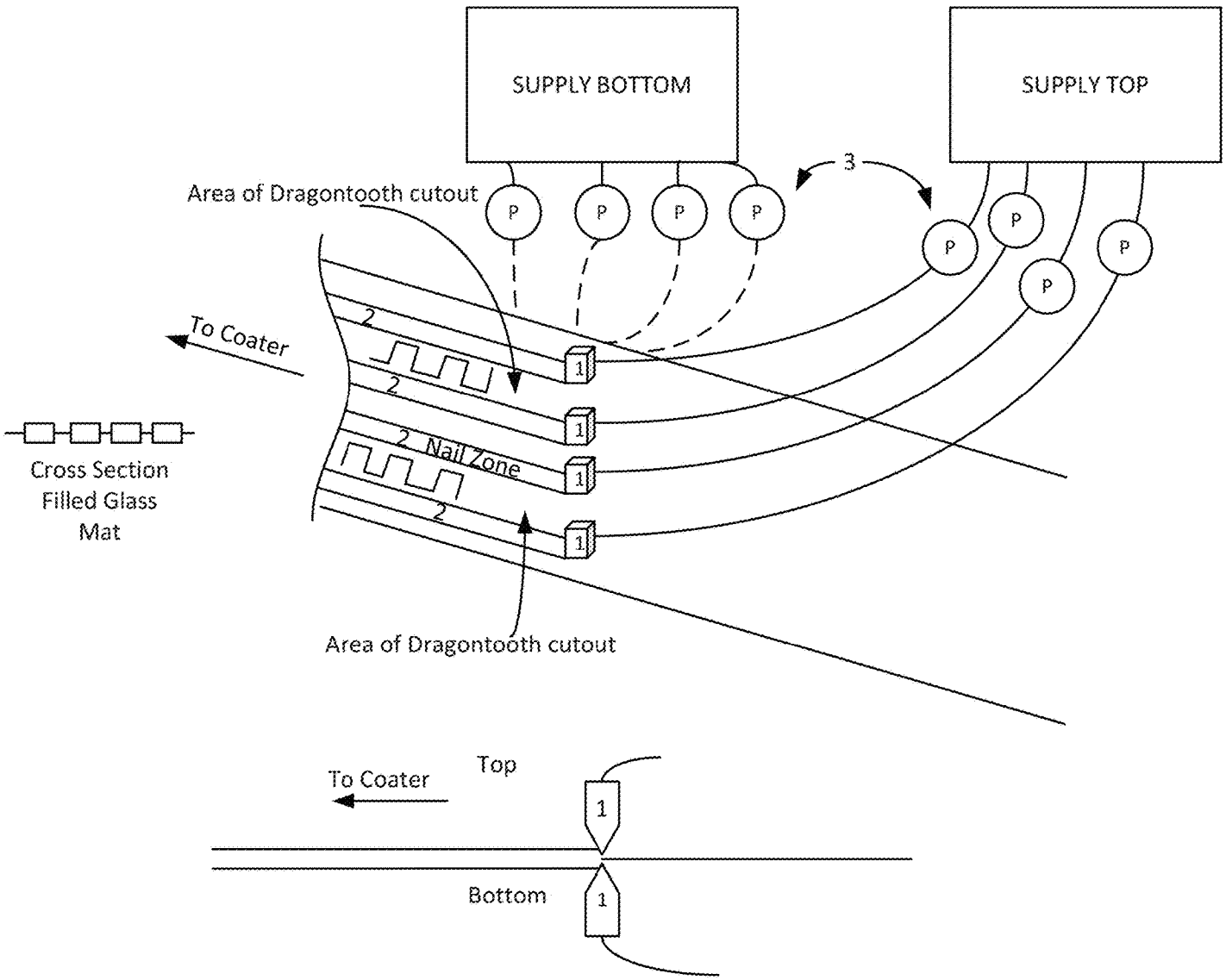
FIGS. 1 and 2 are non-limiting examples of a method of manufacturing an article having a reinforcement material, according to some embodiments.

As used herein, a "reinforced glass mat" is a glass mat that includes a reinforcement material.

As used herein, a "reinforcement material" is any material that, when present in a sufficient amount, provides a nail shank shear resistance described herein, under the measurement conditions (e.g., temperature, test method) described herein.

As used herein, "low penetration point asphalt" is asphalt having a penetration point ranging from 0 mm to 10 mm according to ASTM D-5 at 77° F.

As used herein, a penetration point of 0 mm means that during the ASTM D-5 test at 77° F., a test needle does not penetrate through the asphalt having the penetration point of 0 mm.

As used herein, a "low penetration point asphalt reinforced glass mat" is a reinforced glass mat where the reinforcement material includes a low penetration point asphalt.

As used herein, "oxidized asphalt coating" is defined as a form of processed asphalt that is created by oxidizing asphalt. A non-limiting example of an oxidation procedure is air-blowing, in which air is blown into asphalt at a sufficient temperature (e.g., from 450° F. to 500° F.) to oxidize the asphalt. Other non-limiting examples of oxidation procedures are described in U.S. Pat. Nos. 7,901,563 and 9,556,383, each of which are incorporated by reference in their entireties.

As used herein "nail shank shear resistance" is defined and measured according to ASTM 1761.

As used herein, "surrounding" includes completely surrounding as well as partially surrounding.

As used herein, "polymer modified asphalt coating" is defined as a form of processed asphalt that is created by adding at least one polymer to asphalt. A non-limiting example of a polymer modification procedure is emulsification, in which at least one polymer is mixed with asphalt at a sufficient temperature (e.g., from 250° F. to 350° F.) to form an emulsion. Other non-limiting examples of polymer modification procedures are described in U.S. Pat. No. 8,901,211, which is incorporated by reference in its entirety. In yet other embodiments, the polymer forms a colloid suspension, colloid solution, or dispersion with the asphalt.

Some embodiments of the present disclosure relate to an article including a low penetration point asphalt reinforced glass mat. In some embodiments, the low penetration point asphalt reinforced glass mat includes a glass mat and a reinforcement material in the form of a first asphalt coating. In some embodiments, the first asphalt coating may comprise, consist, or consist essentially of low penetration point asphalt. In some embodiments, the glass mat includes a web of glass fibers. In some embodiments, the web of glass fibers of the glass mat is saturated with a the low penetration point asphalt of the first asphalt coating.

In some embodiments the first asphalt coating comprises, consists or consists essentially of low penetration point asphalt having a penetration point of 1 mm to 10 mm according to ASTM D-5 at 77° F. In some embodiments, the first asphalt coating comprises consists, or consists essentially of low penetration point asphalt having a penetration point of 2 mm to 10 mm according to ASTM D-5 at 77° F. In some embodiments, the first asphalt coating comprises consists, or consists essentially of low penetration point asphalt having a penetration point of 3 mm to 10 mm according to ASTM D-5 at 77° F. In some embodiments, the first asphalt coating comprises consists, or consists essentially of low penetration point asphalt having a penetration point of 4 mm to 10 mm according to ASTM D-5 at 77° F. In some embodiments, the first asphalt coating comprises consists, or consists essentially of low penetration point asphalt having a penetration point of 5 mm to 10 mm according to ASTM D-5 at 77° F. In some embodiments, the first asphalt coating comprises consists, or consists essentially of low penetration point asphalt having a penetration point of 6 mm to 10 mm according to ASTM D-5 at 77° F. In some embodiments, the first asphalt coating comprises consists, or consists essentially of low penetration point asphalt having a penetration point of 7 mm to 10 mm according to ASTM D-5 at 77° F. In some embodiments, the first asphalt coating comprises consists, or consists essentially of low penetration point asphalt having a penetration point of 8 mm to 10 mm according to ASTM D-5 at 77° F. In some embodiments, the first asphalt coating comprises consists, or consists essentially of low penetration point asphalt having a penetration point of 9 mm to 10 mm according to ASTM D-5 at 77° F.

In some embodiments the first asphalt coating comprises, consists or consists essentially of low penetration point asphalt having a penetration point of 0 mm to 9 mm according to ASTM D-5 at 77° F. In some embodiments, the first asphalt coating comprises consists, or consists essentially of low penetration point asphalt having a penetration point of 0 mm to 8 mm according to ASTM D-5 at 77° F. In some embodiments, the first asphalt coating comprises consists, or consists essentially of low penetration point asphalt having a penetration point of 0 mm to 7 mm according to ASTM D-5 at 77° F. In some embodiments, the first asphalt coating comprises consists, or consists essentially of low penetration point asphalt having a penetration point of 0 mm to 6 mm according to ASTM D-5 at 77° F. In some embodiments, the first asphalt coating comprises consists, or consists essentially of low penetration point asphalt having a penetration point of 0 mm to 5 mm according to ASTM D-5 at 77° F. In some embodiments, the first asphalt coating comprises consists, or consists essentially of low penetration point asphalt having a penetration point of 0 mm to 4 mm according to ASTM D-5 at 77° F. In some embodiments, the first asphalt coating comprises consists, or consists essentially of low penetration point asphalt having a penetration point of 0 mm to 3 mm according to ASTM D-5 at 77° F. In some embodiments, the first asphalt coating comprises consists, or consists essentially of low penetration point asphalt having a penetration point of 0 mm to 2 mm according to ASTM D-5 at 77° F. In some embodiments, the first asphalt coating comprises consists, or consists essentially of low penetration point asphalt having a penetration point of 0 mm to 1 mm according to ASTM D-5 at 77° F.

In some embodiments, the first asphalt coating includes up to 100% low penetration point asphalt having a penetration point of 0 mm to 10 mm according to ASTM D-5 at 77° F. In some embodiments, the first asphalt coating includes up to 90% low penetration point asphalt having a penetration point of 0 mm to 10 mm according to ASTM D-5 at 77° F. In some embodiments, the first asphalt coating includes up to 80% low penetration point asphalt having a penetration point of 0 mm to 10 mm according to ASTM D-5 at 77° F. In some embodiments, the first asphalt coating includes up to 70% low penetration point asphalt having a penetration point of 0 mm to 10 mm according to ASTM D-5 at 77° F. In some embodiments, the first asphalt coating includes up to 60% low penetration point asphalt having a penetration point of 0 mm to 10 mm according to ASTM D-5 at 77° F. In some embodiments, the first asphalt coating includes up to 50% low penetration point asphalt having a penetration point of 0 mm to 10 mm according to ASTM D-5 at 77° F. In some embodiments, the first asphalt coating includes up to 40% low penetration point asphalt having a penetration point of 0 mm to 10 mm according to ASTM D-5 at 77° F. In some embodiments, the first asphalt coating includes up to 30% low penetration point asphalt having a penetration point of 0 mm to 10 mm according to ASTM D-5 at 77° F. In some embodiments, the first asphalt coating includes up to 20% low penetration point asphalt having a penetration point of 0 mm to 10 mm according to ASTM D-5 at 77° F. In some embodiments, the first asphalt coating includes up to 10% low penetration point asphalt having a penetration point of 0 mm to 10 mm according to ASTM D-5 at 77° F.

In some embodiments, the reinforced glass mat comprises a sufficient amount of the first asphalt coating so as to result in a nail shank shear resistance of 13 lbs to 17 lbs according to ASTM 1761 at 140° F. In some embodiments, the reinforced glass mat comprises a sufficient amount of the first asphalt coating so as to result in a nail shank shear resistance of 14 lbs to 17 lbs, according to ASTM 1761 at 140° F. In some embodiments, the reinforced glass mat comprises a sufficient amount of the first asphalt coating so as to result in a nail shank shear resistance of 15 lbs to 17 lbs, according to ASTM 1761 at 140° F. In some embodiments, the reinforced glass mat comprises a sufficient amount of the first asphalt coating so as to result in a nail shank shear resistance of 16 lbs to 17 lbs, according to ASTM 1761 at 140° F.

In some embodiments, the reinforced glass mat comprises a sufficient amount of the first asphalt coating so as to result in a nail shank shear resistance of 13 lbs to 16 lbs, according to ASTM 1761 at 140° F. In some embodiments, the reinforced glass mat comprises a sufficient amount of the first asphalt coating so as to result in a nail shank shear resistance of 13 lbs to 15 lbs, according to ASTM 1761 at 140° F. In some embodiments, the reinforced glass mat comprises a sufficient amount of the first asphalt coating so as to result in a nail shank shear resistance of 13 lbs to 14 lbs, according to ASTM 1761 at 140° F.

In some embodiments, the reinforced glass mat comprises a sufficient amount of the first asphalt coating so as to result in a nail shank shear resistance of 14 lbs to 16 lbs, according to ASTM 1761 at 140° F. In some embodiments, the reinforced glass mat comprises a sufficient amount of the first asphalt coating so as to result in a nail shank shear resistance of 14 lbs to 15 lbs, according to ASTM 1761 at 140° F. In some embodiments, the reinforced glass mat comprises a sufficient amount of the first asphalt coating so as to result in a nail shank shear resistance of 15 lbs to 16 lbs, according to ASTM 1761 at 140° F.

In some embodiments, the sufficient amount of the first asphalt coating ranges from 5% to 40% based on a total weight of the article. In some embodiments, the sufficient amount of the first asphalt coating ranges from 10% to 40% based on a total weight of the article. In some embodiments, the sufficient amount of the first asphalt coating ranges from 15% to 40% based on a total weight of the article. In some embodiments, the sufficient amount of the first asphalt coating ranges from 20% to 40% based on a total weight of the article. In some embodiments, the sufficient amount of the first asphalt coating ranges from 25% to 40% based on a total weight of the article. In some embodiments, the sufficient amount of the first asphalt coating ranges from 30% to 40% based on a total weight of the article. In some embodiments, the sufficient amount of the first asphalt coating ranges from 35% to 40% based on a total weight of the article.

In some embodiments, the sufficient amount of the first asphalt coating ranges from 5% to 35% based on a total weight of the article. In some embodiments, the sufficient amount of the first asphalt coating ranges from 5% to 30% based on a total weight of the article. In some embodiments, the sufficient amount of the first asphalt coating ranges from 5% to 25% based on a total weight of the article. In some embodiments, the sufficient amount of the first asphalt coating ranges from 5% to 20% based on a total weight of the article. In some embodiments, the sufficient amount of the first asphalt coating ranges from 5% to 15% based on a total weight of the article. In some embodiments, the sufficient amount of the first asphalt coating ranges from 5% to 10% based on a total weight of the article.

In some embodiments, the glass mat includes a second asphalt coating that is different from the first asphalt coating. In some embodiments, the second asphalt coating is the same as the first asphalt coating.

In some embodiments, the first asphalt coating, the second asphalt coating, or any combination thereof, is an oxidized asphalt coating. In some embodiments, the oxidized asphalt coating includes at least one filler.

In some embodiments, the at least one filler is present in an amount of 1 wt % to 70 wt % based on a total weight of the oxidized asphalt coating. In some embodiments, the at least one filler is present in an amount of 5 wt % to 70 wt % based on a total weight of the oxidized asphalt coating. In some embodiments, the at least one filler is present in an amount of 10 wt % to 70 wt % based on a total weight of the oxidized asphalt coating. In some embodiments, the at least one filler is present in an amount of 15 wt % to 70 wt % based on a total weight of the oxidized asphalt coating. In some embodiments, the at least one filler is present in an amount of 20 wt % to 70 wt % based on a total weight of the oxidized asphalt coating. In some embodiments, the at least one filler is present in an amount of 25 wt % to 70 wt % based on a total weight of the oxidized asphalt coating. In some embodiments, the at least one filler is present in an amount of 30 wt % to 70 wt % based on a total weight of the oxidized asphalt coating. In some embodiments, the at least one filler is present in an amount of 35 wt % to 70 wt % based on a total weight of the oxidized asphalt coating. In some embodiments, the at least one filler is present in an amount of 40 wt % to 70 wt % based on a total weight of the oxidized asphalt coating. In some embodiments, the at least one filler is present in an amount of 45 wt % to 70 wt % based on a total weight of the oxidized asphalt coating. In some embodiments, the at least one filler is present in an amount of 50 wt % to 70 wt % based on a total weight of the oxidized asphalt coating. In some embodiments, the at least one filler is present in an amount of 55 wt % to 70 wt % based on a total weight of the oxidized asphalt coating. In some embodiments, the at least one filler is present in an amount of 60 wt % to 70 wt % based on a total weight of the oxidized asphalt coating. In some embodiments, the at least one filler is present in an amount of 65 wt % to 70 wt % based on a total weight of the oxidized asphalt coating.

In some embodiments, the at least one filler is present in an amount of 1 wt % to 65 wt % based on a total weight of the oxidized asphalt coating. In some embodiments, the at least one filler is present in an amount of 1 wt % to 60 wt % based on a total weight of the oxidized asphalt coating. In some embodiments, the at least one filler is present in an amount of 1 wt % to 55 wt % based on a total weight of the oxidized asphalt coating. In some embodiments, the at least one filler is present in an amount of 1 wt % to 50 wt % based on a total weight of the oxidized asphalt coating. In some embodiments, the at least one filler is present in an amount of 1 wt % to 45 wt % based on a total weight of the oxidized asphalt coating. In some embodiments, the at least one filler is present in an amount of 1 wt % to 40 wt % based on a total weight of the oxidized asphalt coating. In some embodiments, the at least one filler is present in an amount of 1 wt % to 35 wt % based on a total weight of the oxidized asphalt coating. In some embodiments, the at least one filler is present in an amount of 1 wt % to 30 wt % based on a total weight of the oxidized asphalt coating. In some embodiments, the at least one filler is present in an amount of 1 wt % to 25 wt % based on a total weight of the oxidized asphalt coating. In some embodiments, the at least one filler is present in an amount of 1 wt % to 20 wt % based on a total weight of the oxidized asphalt coating. In some embodiments, the at least one filler is present in an amount of 1 wt % to 15 wt % based on a total weight of the oxidized asphalt coating. In some embodiments, the at least one filler is present in an amount of 1 wt % to 10 wt % based on a total weight of the oxidized asphalt coating. In some embodiments, the at least one filler is present in an amount of 1 wt % to 5 wt % based on a total weight of the oxidized asphalt coating.

In some embodiments, the at least one filler is limestone powder, calcium carbonate powder, sand, granules, fly ash, fiberglass particles, stone dust, impurities, or any combination thereof.

In some embodiments, the second asphalt coating is an oxidized asphalt coating, a polymer modified asphalt coating, or any combination thereof.

In some embodiments, the second asphalt coating is an asphalt coating including a filler. In some embodiments, the second asphalt coating without a filler.

In some embodiments, the penetration point of the first asphalt coating is different than the penetration point of the second asphalt coating. In some embodiments, the penetration point of the first asphalt coating is higher than the penetration point of the second asphalt coating. In some embodiments, at least one of the first asphalt coating and the second asphalt coating can include a filler, can be an oxidized asphalt, can be a low penetration point asphalt, can be polymer modified, can have a different composition of one type or multiple types of asphalt, or combinations thereof.

In some embodiments, the penetration point of the second asphalt coating ranges from 15 mm to 45 mm according to ASTM D-5 at 77° F. In some embodiments, the penetration point of the second asphalt coating ranges from 15 mm to 40 mm according to ASTM D-5 at 77° F. In some embodiments, the penetration point of the second asphalt coating ranges from 15 mm to 35 mm according to ASTM D-5 at 77° F. In some embodiments, the penetration point of the second asphalt coating ranges from 15 mm to 30 mm according to ASTM D-5 at 77° F. In some embodiments, the penetration point of the second asphalt coating ranges from 15 mm to 25 mm according to ASTM D-5 at 77° F. In some embodiments, the penetration point of the second asphalt coating ranges from 15 mm to 20 mm according to ASTM D-5 at 77° F.

In some embodiments, the penetration point of the second asphalt coating ranges from 20 mm to 45 mm according to ASTM D-5 at 77° F. In some embodiments, the penetration point of the second asphalt coating ranges from 25 mm to 45 mm according to ASTM D-5 at 77° F. In some embodiments, the penetration point of the second asphalt coating ranges from 30 mm to 45 mm according to ASTM D-5 at 77° F. In some embodiments, the penetration point of the second asphalt coating ranges from 35 mm to 45 mm according to ASTM D-5 at 77° F. In some embodiments, the penetration point of the second asphalt coating ranges from 40 mm to 45 mm according to ASTM D-5 at 77° F.

In some embodiments, a plurality of granules is embedded in the first asphalt coating, the second asphalt coating, or any combination thereof.

In some embodiments, the article comprising the polymer reinforced glass mat is a roofing shingle. In some embodiments, the roofing shingle comprises an asphalt coating surrounding the polymer reinforced glass mat. In some embodiments, a plurality of granules is embedded in the asphalt coating.

In some embodiments, the article has a uniform thickness. In some embodiments, the article has a non-uniform thickness. In some embodiments, the article is a roofing shingle. In some embodiments, the roofing shingle includes a headlap portion, a buttlap portion, a dragontooth portion, and a nail zone.

In some embodiments, the reinforcement material is present in the article as at least one reinforcement region. In some embodiments, the at least one reinforcement region is present on a headlap portion, a buttlap portion, a dragontooth portion, a nail zone, or any combination thereof.

In some embodiments, the at least one reinforcement region has a width of 0.5 inches to 8 inches. In some embodiments the at least one reinforcement region has a width of 1 inch to 8 inches. In some embodiments the at least one reinforcement region has a width of 2 inches to 8 inches. In some embodiments the at least one reinforcement region has a width of 3 inches to 8 inches. In some embodiments the at least one reinforcement region has a width of 4 inches to 8 inches. In some embodiments the at least one reinforcement region has a width of 5 inches to 8 inches. In some embodiments the at least one reinforcement region has a width of 6 inches to 8 inches. In some embodiments the at least one reinforcement region has a width of 7 inches to 8 inches.

In some embodiments the at least one reinforcement region has a width of 0.5 inches to 7 inches. In some embodiments the at least one reinforcement region has a width of 0.5 inches to 6 inches. In some embodiments the at least one reinforcement region has a width of 0.5 inches to 5 inches. In some embodiments the at least one reinforcement region has a width of 0.5 inches to 4 inches. In some embodiments the at least one reinforcement region has a width of 0.5 inches to 3 inches. In some embodiments the at least one reinforcement region has a width of 0.5 inches to 2 inches. In some embodiments the at least one reinforcement region has a width of 0.5 inches to 1 inch.

In some embodiments the at least one reinforcement region has a width of 1 inches to 7 inches. In some embodiments the at least one reinforcement region has a width of 2 inches to 6 inches. In some embodiments the at least one reinforcement region has a width of 3 inches to 5 inches.

In some embodiments, there are 1 to 4 reinforcement regions in the article. In some embodiments, there are 2 to 4 reinforcement regions in the article. In some embodiments, there are 3 to 4 reinforcement regions in the article.

In some embodiments, there are 1 to 3 reinforcement regions in the article. In some embodiments, there are 1 to 2 reinforcement regions in the article.

In some embodiments, there are 2 to 3 reinforcement regions in the article.

In some embodiments, the article is a roofing shingle that includes a plurality of granules embedded in an asphalt coating. In some embodiments, the asphalt coating, the plurality of granules, or any combination thereof, is present on the headlap portion, the buttlap portion, the dragontooth portion, the nail zone, or any combination thereof. In some embodiments, the plurality of granules, the asphalt coating, or combination thereof is present on an entirety of the roofing shingle.

In some embodiments, the asphalt coating is an oxidized asphalt coating, a polymer modified asphalt coating, or any combination thereof.

In some embodiments, the article of the present disclosure is a shingle, and the reinforcement material is present in the nail zone of the shingle. In some embodiments, the reinforcement material is present in at least one portion of the shingle other than the nail zone, such as but not limited to, the headlap portion, the buttlap portion, the dragontooth portion, the nail zone, or any combination thereof. In some embodiments where the article is a shingle including a headlap portion, the reinforcement material may not be present on the headlap portion.

In some embodiments, the reinforcement material includes a tape. In some embodiments, the tape is a polyester tape with a pressure sensitive adhesive backing, nylon tape with adhesives, fiber reinforced tape with adhesives, a scrim tape with an adhesive, or any combination thereof.

In some embodiments, the reinforcement material does not include a tape. In some embodiments, the reinforcement material may include a scrim. In some embodiments, the reinforcement material may take the form of a coating layer that is at least partially embedded in the web of the glass mat. In some embodiments, the coating layer may further include a supplemental coating, such as but not limited to, a hot melt adhesive, a thermoplastic resin, a thermoset resin, or any combination thereof. In some embodiments, the coating layer including the reinforcement material may be applied via roll coating, transfer coating, spray coating, curtain coating, flame coating, thermal spray coating, multi-component coating or two-part sprayer coating, pultrusion coating, or any combination thereof.

Some embodiments of the present disclosure relate to a method of manufacturing an article including the polymer reinforced glass mat. In some embodiments, the method includes obtaining a glass mat comprising a web of glass fibers. In some embodiments, the method further comprises embedding a reinforcement material in the form of a first asphalt coating into the web of glass fibers, so as to form a reinforced glass mat. In some embodiments, the embedding step embeds the reinforcement material into the web of glass fibers in a sufficient amount so as to result in an article having a nail shank shear resistance described herein according to ASTM 1761 at 140° F.

In some embodiments, the embedding is performed using a slot die. In some embodiments, the embedding is performed using a slot die having a two-inch wide zone. In some embodiments, the embedding is performed using a metering wheel. In some embodiments, after embedding the reinforcement material into the web of glass fibers, the method comprises scraping excess reinforcement material from the reinforced glass mat, so as to form an article having a uniform thickness.

In some embodiments, before embedding the reinforcement material into the glass mat, the method comprises preheating the glass mat to a temperature ranging from 350° F. to 525° F. In some embodiments, before embedding the reinforcement material into the glass mat, the method comprises preheating the glass mat to a temperature ranging from 400° F. to 525° F. In some embodiments, before embedding the reinforcement material into the glass mat, the method comprises preheating the glass mat to a temperature ranging from 450° F. to 525° F. In some embodiments, before embedding the reinforcement material into the glass mat, the method comprises preheating the glass mat to a temperature ranging from 500° F. to 525° F.

In some embodiments, before embedding the reinforcement material into the glass mat, the method comprises preheating the glass mat to a temperature ranging from 350° F. to 500° F. In some embodiments, before embedding the reinforcement material into the glass mat, the method comprises preheating the glass mat to a temperature ranging from 350° F. to 450° F. In some embodiments, before embedding the reinforcement material into the glass mat, the method comprises preheating the glass mat to a temperature ranging from 350° F. to 400° F.

In some embodiments, before embedding the reinforcement material into the glass mat, the method comprises preheating the glass mat to a temperature ranging from 400° F. to 500° F. In some embodiments, before embedding the reinforcement material into the glass mat, the method comprises preheating the glass mat to a temperature ranging from 400° F. to 450° F. In some embodiments, before embedding the reinforcement material into the glass mat, the method comprises preheating the glass mat to a temperature ranging from 450° F. to 500° F.

In some embodiments, the article comprising the reinforced glass mat is formed into a roofing shingle. In some embodiments the roofing shingle is formed by applying a second asphalt coating to the reinforced glass mat and embedding a plurality of granules within the reinforcement material, the second asphalt coating, or any combination thereof. In some embodiments, the method further comprises scraping excess reinforcement material, excess second asphalt coating, excess granules, or any combination thereof, so as to form a roofing shingle having a uniform thickness.

In some embodiments, applying the asphalt coating to the glass mat includes coating a portion of the glass mat with a first asphalt coating. In some embodiments, applying the asphalt coating to the glass mat further comprises coating a portion of the glass mat with a second asphalt coating. In some embodiments, the first asphalt coating and the second asphalt coating are different. In some embodiments, applying the asphalt coating to the reinforced glass mat includes coating the web of fibers of the glass mat with an oxidized asphalt coating.

In some embodiments, the method further comprises embedding a plurality of granules within the asphalt coating, so as to form a shingle, such as but not limited to, a roofing shingle.

Figure 2:
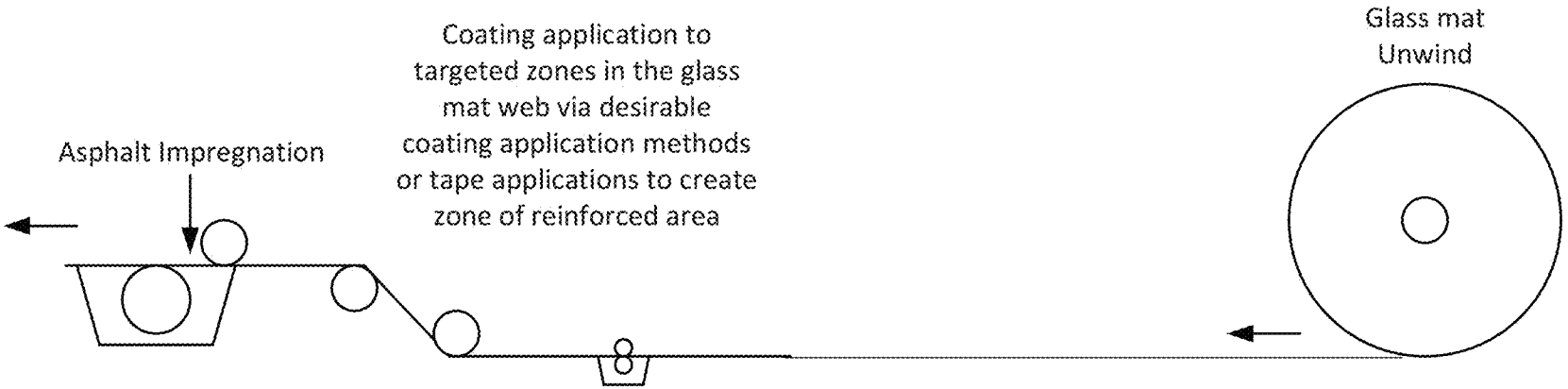

A non-limiting example of a method of manufacturing an article having a reinforcement material according to the present disclosure, is shown in FIGS. 1 and 2.

As shown in FIG. 1, the non-limiting exemplary method may comprise using a slot die comprising pumps (P) to inject a reinforcement material (such as but not limited to a polymeric binder), thereby embedding the reinforcement material into empty spaces on a web of the glass mat. As shown, in some embodiments, the embedding of the reinforcement material may create a strengthened cross section. The pumps (P) of the slot dies may, in some embodiments, be electronically geared to the line speed to provide a sufficient amount of the reinforcement material (as described herein) to fill the glass mat thereby forming a nail zone before reaching an asphalt coating area of the production line.

As shown in FIG. 2, in some non-limiting embodiments, the reinforcement material may be applied as a coating layer, during a shingle manufacturing process, so as to form at least one reinforcement region. As shown, the coating layer may, in some embodiments, be applied in the manufacturing process, before application (e.g., impregnation) of an asphalt coating. As shown, the coating layer may, in some embodiments, be applied in the manufacturing process, after unwinding the glass mat and after accumulating the glass mat.

Figure 3:
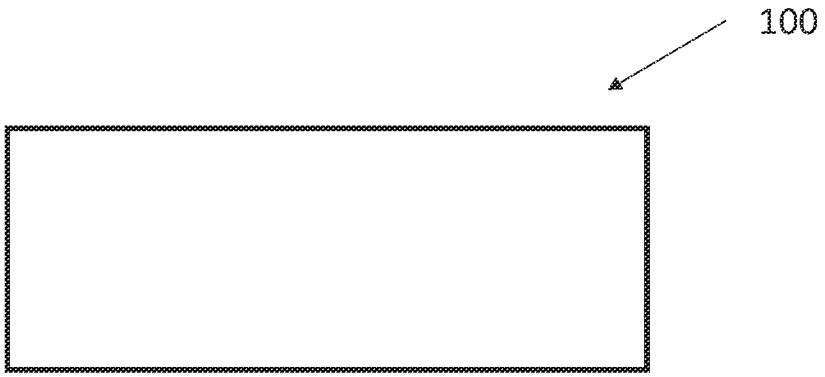
FIG. 3 is a non-limiting example of a roofing article having the reinforcement material, according to some embodiments.

FIG. 3 shows a non-limiting example of a roofing article 100 manufactured by the method shown in FIGS. 1 and 2, according to some embodiments. In some embodiments, the roofing article 100 is a roofing shingle.

Among those benefits and improvements that have been disclosed, other objects and advantages of this disclosure will become apparent from the following description taken in conjunction with the accompanying figures. Detailed embodiments of the present disclosure are disclosed herein. However, it is to be understood that the disclosed embodiments are merely illustrative of the disclosure that may be embodied in various forms. In addition, each of the examples given regarding the various embodiments of the disclosure which are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though it may. Furthermore, the phrases "in another embodiment" and "in some other embodiments" as used herein do not necessarily refer to a different embodiment, although it may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising" "including," and "having" do not limit the scope of a specific claim to the materials or steps recited by the claim.

As used herein, the term "consisting essentially of" limits the scope of a specific claim to the specified materials or steps and those that do not materially affect the basic and novel characteristic or characteristics of the specific claim.

As used herein, terms such as "consisting of" and "composed of" limit the scope of a specific claim to the materials and steps recited by the claim.

All prior patents, publications, and test methods referenced herein are incorporated by reference in their entireties. Variations, modifications, and alterations to embodiments of the present disclosure described above will make themselves apparent to those skilled in the art. All such variations, modifications, alterations, and the like are intended to fall within the spirit and scope of the present disclosure, limited solely by the appended claims.

While several embodiments of the present disclosure have been described, it is understood that these embodiments are illustrative only, and not restrictive, and that many modifications may become apparent to those of ordinary skill in the art. For example, all dimensions discussed herein are provided as examples only, and are intended to be illustrative and not restrictive.

Any feature or element that is positively identified in this description may also be specifically excluded as a feature or element of an embodiment of the present as defined in the claims.

The disclosure described herein may be practiced in the absence of any element or elements, limitation or limitations, which is not specifically disclosed herein. Thus, for example, in each instance herein, any of the terms "comprising," "consisting essentially of" and "consisting of" may be replaced with either of the other two terms, without altering their respective meanings as defined herein. The terms and expressions which have been employed are used as terms of description and not of limitation, and there is no intention in the use of such terms and expressions of excluding any equivalents of the features shown and described or portions thereof, but it is recognized that various modifications are possible within the scope of the disclosure.

What is claimed is:

1. A roofing shingle, comprising:

a reinforced glass mat, wherein the reinforced glass mat comprises:

a glass mat, wherein the glass mat comprises a web of glass fibers; and a first asphalt coating on at least a portion of the glass mat, wherein the first asphalt coating is at least partially embedded into the web of glass fibers, wherein the first asphalt coating comprises low penetration point asphalt, wherein low penetration point asphalt is asphalt that has a penetration point ranging from 0 mm to 10 mm according to ASTM D-5 at 77° F.; and a second asphalt coating surrounding the first asphalt coating, wherein the second asphalt coating is different from the first asphalt coating, wherein the penetration point of the second asphalt coating ranges from 15 mm to 45 mm according to ASTM D-5 at 77° F.;

wherein the reinforced glass mat comprises the first asphalt coating in a sufficient amount, so as to result in the reinforced glass mat having a nail shank shear resistance of 13 lbs to 17 lbs, according to ASTM 1761 at 140° F.

2. The roofing shingle of claim 1, wherein the first asphalt coating is an oxidized asphalt coating comprising at least one filler.

3. The roofing shingle of claim 2, wherein the at least one filler is present in an amount of 1 wt % to 70 wt % based on a total weight of the oxidized asphalt coating.

4. The roofing shingle of claim 3, wherein the at least one filler is limestone powder, calcium carbonate powder, sand, granules, fly ash, fiberglass particles, stone dust, impurities, or any combination thereof.

5. The roofing shingle of claim 1, wherein the sufficient amount of the first asphalt coating in the roofing shingle ranges from 5 wt % to 40 wt % based on a total weight of the roofing shingle.

6. The roofing shingle of claim 1, wherein the second asphalt coating is an oxidized asphalt coating, a polymer modified asphalt coating, or any combination thereof.

7. The roofing shingle of claim 6, wherein the second asphalt coating comprises at least one filler.

8. The roofing shingle of claim 5, wherein the second asphalt coating does not comprise at least one filler.

9. The roofing shingle of claim 5, comprising a plurality of granules, wherein the plurality of granules is embedded in the first asphalt coating, embedded in the second asphalt coating, or any combination thereof.

10. The roofing shingle of claim 9, wherein the roofing shingle includes a headlap portion, and wherein the first asphalt coating or the second asphalt coating is not present on the headlap portion.

11. The roofing shingle of claim 1, wherein the roofing shingle includes a headlap portion, and wherein the second asphalt coating is present on the headlap portion.

12. The roofing shingle of claim 1, wherein an entirety of the roofing shingle has a uniform thickness.

13. The roofing shingle of claim 1, wherein the roofing shingle includes a nail zone, and wherein the first asphalt coating or the second asphalt coating is present in the nail zone.

14. The roofing shingle of claim 13, wherein the first asphalt coating or the second asphalt coating is present in at least one portion of the roofing shingle other than the nail zone.

* * * * *